US005298064A

United States Patent [19]

Dessauer et al.

[11] Patent Number: 5,298,064

[45] Date of Patent: Mar. 29, 1994

[54] WATER-CONTAINING ORGANOPHILIC PHYLLOISILICATES

[75] Inventors: Guido Dessauer, Tutzing; Ute Horn, Dornburg, both of Fed. Rep. of Germany

[73] Assignee: Hoechst Aktiengesellschaft, Frankfurt am Main, Fed. Rep. of Germany

[21] Appl. No.: 803,345

[22] Filed: Dec. 4, 1991

[30] Foreign Application Priority Data

Dec. 6, 1990 [DE] Fed. Rep. of Germany ..... 4038886

[51] Int. Cl.[5] ..... C08K 3/36

[52] U.S. Cl. ..... 106/287.34; 106/DIG. 4; 162/135; 428/537.5

[58] Field of Search ..... 106/DIG. 4, 287.34, 106/416; 428/537.5

[56] References Cited

U.S. PATENT DOCUMENTS 3,131,148 4/1964 Tauli ..... 106/287.34
3,519,453 7/1970 Morris et al. ..... 106/287.34
3,778,283 12/1973 von Freyhold ..... 106/287.34
4,867,844 9/1989 Dessauer ..... 162/135

FOREIGN PATENT DOCUMENTS 0192252 3/1989 European Pat. Off. ..... 1/22

OTHER PUBLICATIONS

Kirk–Othmer, *Encyclopedia of Chemical Technology*, 3rd Ed., vol. 6, 1979, p. 200.

*Primary Examiner*—P. C. Sluby

[57] ABSTRACT

The invention relates to the use of water-containing organophilic phyllosilicates obtained by the reaction of a phyllosilicate, which is completely delaminated colloidally in water and is capable of cation exchange, with an organic onium salt in aqueous suspension and subsequent mechanical removal of the water, without drying by heating, as a rheological additive in organic media. The water-containing organophilic phyllosilicates are particularly suitable for coating paper.

16 Claims, No Drawings

WATER-CONTAINING ORGANOPHILIC PHYLLOISILICATES

DESCRIPTION

It is widely known that organophilically modified phyllosilicates can be employed as rheological additives in organic media. Examples of these are the commercial products marketed under the names ®Tixogel (manufacturer: Südchemie AG) and ®Bentone. These rheological additives have the effect of the build-up of a thixotropic structure in organic media, for example in paints and varnishes. As a result of this thixotropic structure, such organic media are easier to process. The organophilically modified phyllosilicates are obtained by treating phyllosilicates in aqueous suspension with an aqueous solution of an onium compound, preferably a quaternary organic ammonium salt, this organic ammonium salt being embedded between the layers of the phyllosilicate. The phyllosilicate organophilically modified in this manner is then separated from the water by filtration and dried under the action of heat, for example in a drum drier at about 100° C. The modified organophilic phyllosilicates obtained in this manner are water-insoluble.

Such a drying operation has previously been considered necessary, since the filtercake obtained when the water is filtered off contains considerable amounts of water, and this water content has been said to interfere in the use of the organophilic phyllosilicates in the organic media. It has now been found, surprisingly, that this is not the case and that the filtercake of such organophilic phyllosilicates can be employed as a rheological additive in organic media even without being dried.

The invention thus relates to the use of water-containing organophilic phyllosilicates which are obtained by the reaction of a phyllosilicate, which is completely delaminated colloidally in water and is capable of cation exchange, with an organic onium salt in aqueous suspension and subsequent mechanical removal of the water, without drying by heating, as a rheological additive in organic media and for coating paper.

These organophilic phyllosilicates are obtained by methods which are known per se, which therefore do not have to be explained in more detail. Possible phyllosilicates which are capable of cation exchange and are completely delaminated colloidally in water are all the synthetic or naturally occurring smectic phyllosilicates, preferably bentonite or montmorillonite, which, in addition to a smectic phyllosilicate, can also contain 25–30% by weight of impurities in the form of other minerals. The minerals are treated with an aqueous solution of onium compounds, such as, for example, phosphonium compounds, but preferably quaternary organic ammonium salts, these compounds being embedded between the layers of these minerals. Possible quaternary organic ammonium salts are, in particular, compounds of the formula

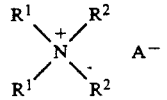

in which $R^1$ is $C_8$–$C_{22}$-alkyl or $C_8$–$C_{22}$-alkenyl, $R^2$ is $C_1$–$C_4$-alkyl and A is an anion, preferably chloride or methosulate. The compound distearyl-dimethylammonium chloride is particularly preferred. When the phyllosilicate is charged with the quaternary organic ammonium salt, the water is filtered off or pressed off. This is done by the customary processes of separation. The filtercake obtained consists, depending on the purity of the phyllosilicates, to the extent of about 65 to 83% of water and is employed according to the invention in this form directly as a rheological additive in organic media.

Examples of organic media in the sense of this invention are paints, varnishes, coatings, putties, lubricating greases, cosmetics, paint removers, filler compositions and similar formulations containing organic solvents. The water-containing organophilically modified phyllosilicates according to the invention have a thixotroping effect in all these systems. As a result of this effect, the formulations mentioned are easier to process. In addition, these phyllosilicates also prevent settling of the insoluble components, for example the pigments within these media. As another surprising effect of these water-containing organophilic phyllosilicates it has been found that the thickening action here is significantly higher in comparison with the analogous commercially available products having the same solids content, but from which the water has been removed by drying by heating.

These water-containing organophilically modified phyllosilicates are added to the organic media by methods which are known per se. The amount of these rheological additives also lies within the range known to the expert in this field (about 0.5 to 3% by weight).

The water-containing organophilic phyllosilicates according to the invention are particularly suitable for coating paper. From economic considerations, efforts are made to use thin printing papers for printed products with a high circulation, for example newspapers or mailorder catalogs. However, problems arise here in respect of opacity, i.e. in the case of printing the print shows through in an interfering manner on the other side of the paper. To prevent this effect, it is already known (EP 192 252) that paper can be coated with an organophilic complex of a smectic phyllosilicate and a quaternary organic ammonium compound from a suspension in organic solvents. The starting material is present here in a form from which as much of the water as possible has been removed by heating. In the context of the present invention, it has now been found that drying of the organophilically modified phyllosilicate can be dispensed with in this process (solvent coating) and the water-containing presscake of this organophilically modified phyllosilicate can be employed directly. It is surprising here that the water in the presscake does not interfere with the homogeneity of the overall organic system. The water remains in the inner phase, and no swelling of the paper fibers occurs, as would be the case with an aqueous coating. This finding is therefore of relatively great importance, since in future such "solvent coating" processes based on toluene or white spirit will gain increasing importance. The solids content (i.e. without the content of water from the presscake) of such suspensions is about 3 to 9% by weight. These "solvent coating" suspensions can furthermore also contain white pigments ($TiO_2$). As a result of the ability of the organophilically modified phyllosilicates to form films, these white pigments are bonded firmly to the paper by the phyllosilicates; no additional binder is therefore needed. A good hold-out effect is obtained in this manner, i.e. print-through on the printed paper is prevented.

EXAMPLES

A commercially available, non-purified Na bentonite (exchange capacity 80 milliequivalents/100 g) was stirred in a hot solution of distearyl-dimethyl-ammonium chloride at a ratio of the two products of 69% by weight of Na bentonite and 31% by weight of quaternary organic ammonium salt. When the reaction had ended, the mixture was filtered and the now organophilically modified bentonite was pressed off to a solids content of about 31% by weight. This filtercake was dispersed in toluene and the dispersion was applied in a thin layer to a sheet of paper and dried. The details of the examples and the particular evaluation of the hold-out effect can be seen from the following Tables 1 and 2.

As the examples show, a very good hold-out effect is obtained with the water-containing organophilic phyllosilicates according to the present invention. The examples in the table show that customary white pigments can also be applied to the paper and firmly anchored there by means of the dispersion of the organophilically modified phyllosilicate in toluene; no additional binder is required here.

TABLE 1

| | 1 | 2 | 3 |
|---|---|---|---|
| Toluene | 87.5 g | 85 g | 82.5 g |
| Filtercake | 12.5 g | 15 g | 17.5 g |
| Brookfield viscosity in mPas at 100 rpm after 2 days | 308 | 528 | 720 |
| Weight applied ($g/m^2$) | 1.5–1.8 | 1.6–1.7 | 1.4–1.6 |
| Hold-out | good | good | good |
| Weight applied ($g/m^2$) | 2.3–2.5 | 2.8–3.0 | 2.5–2.7 |
| Hold-out | very good | best | very good |

TABLE 2

| | 3 | 4 | 5 |
|---|---|---|---|
| Toluene | to 100 | to 100 | to 100 |
| Filtercake | 15 g | 15 g | 15 g |
| Titanium dioxide | | 0.4 | |
| China clay | | | 0.4 g |
| Optical brightener | | | 0.1 g |
| Brookfield viscosity in mPas at 100 rpm after 2 days | 298 | 324 | 216 |
| Weight applied ($g/m^2$) | 1.3 | 1.4 | 1.5 |
| Hold-out | good | good | good |

We claim

1. An organic medium containing a water-containing organophilic phyllosilicate obtained by the reaction of a cation-exchanging phyllosilicate, which has been completely delaminated colloidally in water, with an organic onium salt in aqueous suspension, the cation-exchanging phyllosilicate having undergone cation exchange during the reaction and subsequent removal of the water which removal consists essentially of a mechanical water removal step, said removal leaving the cation-exchanging phyllosilicate with some residual water.

2. The organic medium as claimed in claim 1, wherein the water-containing organophilic phyllosilicate is obtained from a filtercake containing at least about 65% by weight of water.

3. A method of preparing an organic medium that contains a phyllosilicate, comprising the step of:

adding to the organic medium a water-containing organophilic phyllosilicate which has been obtained by reacting, in an aqueous reaction medium, the components comprising a delaminated, cation-exchanging phyllosilicate and an organic onium salt, said delaminated, cation-exchanging phyllosilicate having been essentially completely delaminated colloidally in water and undergoing, during the reaction, cation exchange, thereby providing an aqueous suspension containing an organophilic phyllosilicate, isolating the resulting organophilic phyllosilicate from said aqueous suspension, said isolating step leaving some residual water in said organophilic phyllosilicate, the thus-isolate organophilic phyllosilicate containing said residual water being the water-containing organophilic phyllosilicate added to the organic medium.

4. The method as claimed in claim 3, wherein the water-containing organophilic phyllosilicate is obtained by reacting said components to obtain said aqueous suspension, filtering the resulting organophilic phyllosilicate from said aqueous suspendsion to obtain a filtercake comprising the organophilic phyllosilicate and a portion of the water of said aqueous suspension.

5. The method as claimed in claim 4, wherein said filtercake contains at least about 65% by weight of water.

6. The method as claimed in claim 4, wherein said filter cake is dispersed in the organic medium.

7. The method as claimed in claim 3, wherein the water-containing organophilic phyllosilicate is added to an organic solvent to form a suspension or dispersion of said phyllosilicate in the organic solvent.

8. The method as claimed in claim 3, wherein the delaminated phyllosilicate comprises an Na bentonite.

9. The method as claimed in claim 3, wherein the organic onium salt is an organic quaternary ammonium salt.

10. The method as claimed in claim 9, wherein the quaternary ammonium salt is distearyl-dimethyl-ammonium chloride.

11. The method as claimed in claim 3, wherein the resulting organic medium containing the phyllosilicate is thixotropic.

12. The method as claimed in claim 3, wherein the resulting organic medium contains about 0.5 to about 3% by weight of said water-containing organophilic phyllosilicate.

13. The method as claimed in claim 3, wherein the organic medium contains a pigment.

14. A method as claimed in claim 3, for modifying the rheology of an organic medium or for preparing an organic coating composition containing a phyllosilicate, comprising the steps of:

reacting, in an aqueous reaction medium, an organic onium salt and a cation-exchanging phyllosilicate which has been essentially completely delaminated colloidally in water and which undergoes, during the reaction cation exchange with the organic onium salt, thereby providing an aqueous suspension containing an organophilic phyllosilicate, removing the water from said aqueous suspension by means consisting essentially of mechanical means, thereby obtaining a water-containing organophilic phyllosilicate, and adding the water-containing organophilic phyllosilicate to the organic medium.

15. The method as claimed in claim 14, wherein water is removed from said aqueous suspension by filtration to obtain a filter cake containing organophilic phyllosilicate and residual water, and said filter cake is added to the organic medium essentially without conducting any further water removal steps.

16. The method as claimed in claim 14, wherein said organic coating composition contains a pigment.

* * * * *